United States Patent [19]

Blazley

[11] Patent Number: 4,896,466

[45] Date of Patent: Jan. 30, 1990

[54] CONSTRUCTION METHOD AND APPARATUS

[75] Inventor: Wade H. Blazley, Orange, Australia

[73] Assignee: Blazley Designs Pty. Ltd., Miami, Australia

[21] Appl. No.: 184,144

[22] Filed: Apr. 21, 1988

Related U.S. Application Data

[63] Continuation-in-part of Ser. No. 83,909, Aug. 6, 1987, Pat. No. 4,759,159, which is a continuation of Ser. No. 845,139, Feb. 28, 1986, abandoned.

[51] Int. Cl.[4] ..... E04B 1/32

[52] U.S. Cl. ..... 52/7; 52/86

[58] Field of Search ..... 52/748, 749, 588, 542, 52/86; 29/254, 453, 450; 24/498, 499, 400

[56] References Cited

U.S. PATENT DOCUMENTS

| | | | |
|---|---|---|---|
| 2,354,485 | 7/1944 | Slaughter | 29/453 |
| 2,997,765 | 8/1961 | Markoff-Moghadam | 24/400 |
| 3,173,199 | 3/1965 | DeRidder | 29/235 |
| 3,481,094 | 12/1969 | Taylor | 52/588 |
| 3,959,856 | 6/1976 | Ausnit | 24/399 |
| 3,967,430 | 7/1976 | Knudson | 52/748 |
| 4,192,117 | 3/1980 | Heirich | 52/542 |
| 4,463,533 | 8/1984 | Mallet | 52/542 |
| 4,525,976 | 7/1985 | Simpson | 52/748 |

FOREIGN PATENT DOCUMENTS

| | | | |
|---|---|---|---|
| 550479 | 12/1957 | Canada | 24/400 |
| 553252 | 2/1958 | Canada | 29/528 |
| 709702 | 6/1954 | United Kingdom | 24/400 |

*Primary Examiner*—Henry E. Raduazo

*Attorney, Agent, or Firm*—Natter & Natter

[57] ABSTRACT

A method for construction of self supporting buildings of the type comprising longitudinally arcuate interlocking panels having a joint of the type described in U.S. Pat. No. 4,759,159 wherein the respective male and female ribs of adjacent panels are overlaid and then progressively interlocked along the edges of the joint by a sliding compression tool. The compression tool has slides or rollers which engage outwardly opposing exposed surfaces of respective male and female ribs comprising the joint and permits resilient deformation of the male and female ribs to achieve interlocking.

9 Claims, 4 Drawing Sheets

CONSTRUCTION METHOD AND APPARATUS

CROSS REFERENCE TO RELATED APPLICATIONS

This application is a continuation-in-part of application Ser. No. 083,909 filed Aug. 6, 1987 now U.S. Pat. No. 4,759,159 which is a continuation of application Ser. No. 845,139 filed Feb. 28, 1986, now abandoned.

BACKGROUND OF THE INVENTION

1. Field of the Invention

This invention relates to a method and apparatus for construction of self-supporting buildings of the type comprising arcuate interlocking panels and in particular to interlocking panels having a joint of the type described in my co-pending application Ser. No. 083,909 now U.S. Pat. No. 4,759,159.

2. Description of the Prior Art

The prior art discloses numerous examples of interlocking building panels which secure together without any additional locking means such as crimping, bolting, or the like. Typical examples of such panels are described in U.S. Pat. Nos. 4,109,437 (PLAYER et al); 4,223,503 (HAGUE); 4,192,117 (HEIRICH); 4,463,533 (MULLET); 3,606,718 (CURRAN), German Patent No. 2,205,479 (KASPAR) and Russian Patent No. 1,054,5112.

Each of the above patents is concerned with interlocking planar panels which in use must be supported by a support member extending transversely to the interlocking joints between adjacent panels. In building construction the support member is typically a building framework to which the interlocking panels are affixed by bolts etc. to form roof and wall surfaces.

It is known to form a self-supporting structure from arcuate interlocking panels. Typical examples of such arcuate structures are described in U.S. Pat. No. 3,276,171 (BROWN); Swiss Patent No. 332,721 (CENTRAL FARM EQUIPMENT COMPANY, CHICAGO, ILL.), and U.S. Pat. No. 3,902,288 (KNUDSON).

Brown describes an arcuate continuous channel shaped panel which interlocks with adjoining panels in edge to edge relationship by engaging opposed ends of adjacent male and female interlocking ribs and then longitudinally sliding the interengaging edges together. Although when assembled a strong weatherproof joint is achieved, considerable force is required to effect the sliding joint due to increasing frictional engagement and this may require substantial reinforcing (at least temporary) of the building structure to withstand these forces. This method of building construction is limited to elevated arcuate self supporting roofs of relatively large arcuate diameter due to the arcuate extension of a panel being joined to an adjacent panel in situ on the roof.

Swiss Patent No. 332721 (CENTRAL FARM EQUIPMENT COMPANY) describes the use of short arcuate panels which are joined at opposing ends and opposing edges by bolted connections passing through perforations in the panels to form an arcuate roof structure. The erection of such structures is highly labour intensive and suffers the disadvantage of leak prone jointing means passing through perforations in the panels.

KNUDSON describes an arcuate panel having a trough shaped cross section. The panels of this invention are joined above abutting edges by a simple crimped joint which is formed by folding a flange along a free edge of one panel through 90° to engage a flange of an adjoining panel. When steel sheet employing a corrosion resistant coating of zinc, zinc alloy or polymeric materials is utilized, stress cracking of the corrosion resistant coating can occur with subsequent corrosion of the crimped joint.

The KNUDSON specification also discloses a method and apparatus for roll forming of arcuate panels having a trough-like cross sectional shape. The general description of the roll forming apparatus and method is incorporated in the present description by way of cross-reference.

SUMMARY OF THE INVENTION

The principal object of this invention is to provide a method of construction of self supporting buildings utilizing a building panel and joint of the type described in my U.S. Pat. No. 4,759,159, the description of which is incorporated herein by cross-reference.

A further object of this invention is to provide an apparatus for forming a joint between adjacent panels in a building constructed in accordance with the method according to the invention.

The present invention provides a method for constructing a self supporting building of the type comprising a plurality of building panels of generally arcuate configuration in respective longitudinal directions, each said building panel having in its transverse cross-direction, a main concave body portion, a pair of side engagement portions at the respective opposite sides of said main body portion, each said side portion including flange means extending away from said main body portion on the concave side thereof, the flange means of one said side portion terminating in a female rib and the flange means of the other said side portion terminating in a male rib adapted for interlocking engagement with a said female rib of a further said panel whereby adjacent said panels may be interlocked in use to define a generally arcuate roof structure, said female rib extending wholly to one side of its supporting flange means and away from said main body portion and said male rib extending from its supporting flange means in the same direction as said female rib whereby to permit adjacent said panels to be overlapped at the adjacent said side portions and be moved in the general direction of said side portions to enable said male rib of one said panel to engage and interlock with said female rib of the adjacent said panel; said method comprising the steps of:

(1) erecting a first panel member with respective free ends of said panel member supported on a pre-prepared support base;

(2) placing a second panel member adjacent said first panel member with a respective female rib of one of said panel members overlying a respective male rib of the other of said panel members;

(3) aligning one free end of said second panel member with an adjacent free end of said first panel member;

(4) applying relatively opposed forces between said respective male and female ribs to force said respective male and female ribs into interlocking engagement in the region adjacent said one free end of said second panel member aligned with an adjacent free end of said first panel member;

(5) progressively moving longitudinally along adjacent overlying respective male and female ribs the application of opposed forces between said respective male and female ribs to place said male and female ribs of respective adjacent panel members into interlocking engagement along respective longitudinal edges of said first and second panel members; and (6) repeating steps (2) to (5) with further panel members to form a building of desired dimensions.

The present invention also provides an apparatus for carrying out the method according to the invention, the apparatus comprising rib engaging members adapted to engage between opposing exposed surfaces of respective male and female ribs of adjacent said building panels and to apply opposing forces thereto to bring said respective male and female ribs into interlocking engagement.

DESCRIPTION OF THE PREFERRED EMBODIMENT(S)

Figure 1:
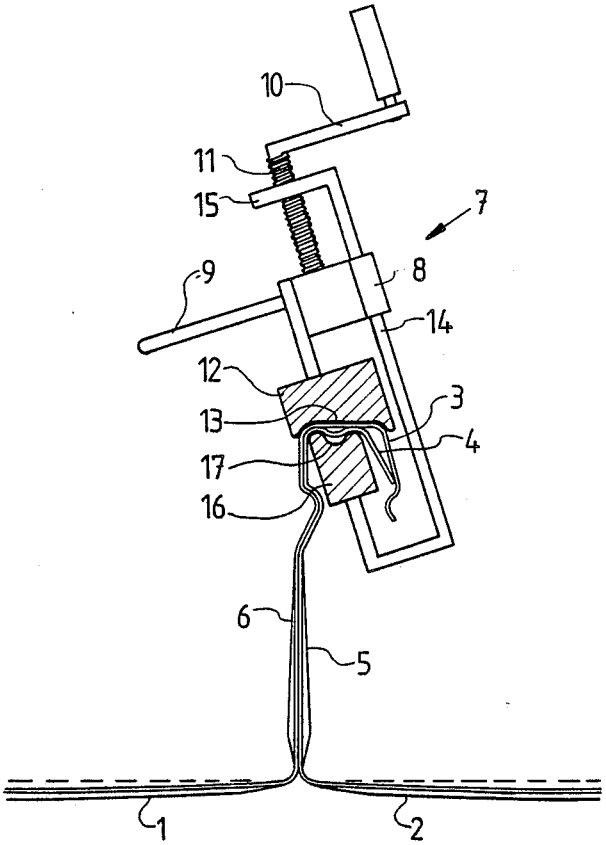
FIG. 1 shows partial cross sections of building panels described in my U.S. Pat. No. 4,759,159 with respective female and male ribs being interlocked with an apparatus according to the invention.

In my U.S. Pat. No. 4,759,159 a detailed description is given of a building panel having interlocking male and female ribs shown generally in FIG. 1 of the drawings accompanying this application.

Roll forming of straight metal sections having a concave or trough-like cross-section is well known. It is equally well known that such roll formed metal sections may be formed into arcuate shapes by the formation of crimped deformations in the floor and side walls of the trough-like section. An advantage of the present invention is that it provides a method for rapid and simple erection of a self supporting structure using relatively unskilled labour and employing roll formed metal sections produced on-site with a portable roll forming apparatus.

After preparation of the support foundations for the proposed structure (described with reference to FIG. 3) a plurality of arcuate, trough-like building panels are formed. Generally, the straight roll formed section is produced to a desired length with the floor at the base and the side walls upright. The straight section is then rotated through 90° about its longitudinal axis and is passed back through the crimping rollers of the roll former to produce an arcuate channel shaped member with its axis of curvature oriented vertically.

A first panel is supported on a horizontal surface then a second panel 2 is positioned by a number of workers with the female rib 3 of first panel overlying male rib 4 of second panel 2. The side wall 5 of panel 2 rests upon side wall 6 of panel 1 to assist in supporting panel 2 and locating male rib 4.

The free ends of panels 1 and 2 are aligned at one end and locking tool 7 is clamped over the aligned ends of the overlapping male and female ribs 4, 3 respectively.

The locking tool comprises a body 8 having a fixed handle 9 and a cranked handle 10 rotatably mounted in body 8 about shaft 11. Mounted on body 8 is an elongate slider block 12 having a shaped surface 13 complementary to the outer surface of female rib 3. A bracket 14 is slidably mounted in body 8 and is adjustable by means of a screw threaded aperture in arm 15 through which screw threaded shaft 11 extends. Mounted on the other end of bracket 14 is a further slider block 16 having a surface 17 generally complementary to the exposed surface of male rib 4 which opposes the corresponding portion of female rib 3. The relative distance between slider block surfaces 13 and 17 is selectively altered by cranking handle 10.

With the locking tool 7 clamped over the aligned ends of panels 1 and 2 cranked handle 10 is then rotated to force slider blocks 12 and 16 towards each other until the end portion of the overlapping female and male ribs 3, 4 are interlocked.

Handle 9 is then grasped and locking tool 7 is moved longitudinally over the overlapping female and male ribs 3, 4 to progressively interlock panels 1, 2 over their entire length. As the tool moves over the overlapping ribs 3, 4, female rib 3 is resiliently expended whereas male rib 4 is resiliently compressed to enable male rib 4 to fully enter female rib 3 and lockingly engage therein.

The process is then repeated with further building panels until a panel member comprising say five interlocked panels is formed.

Figure 3:
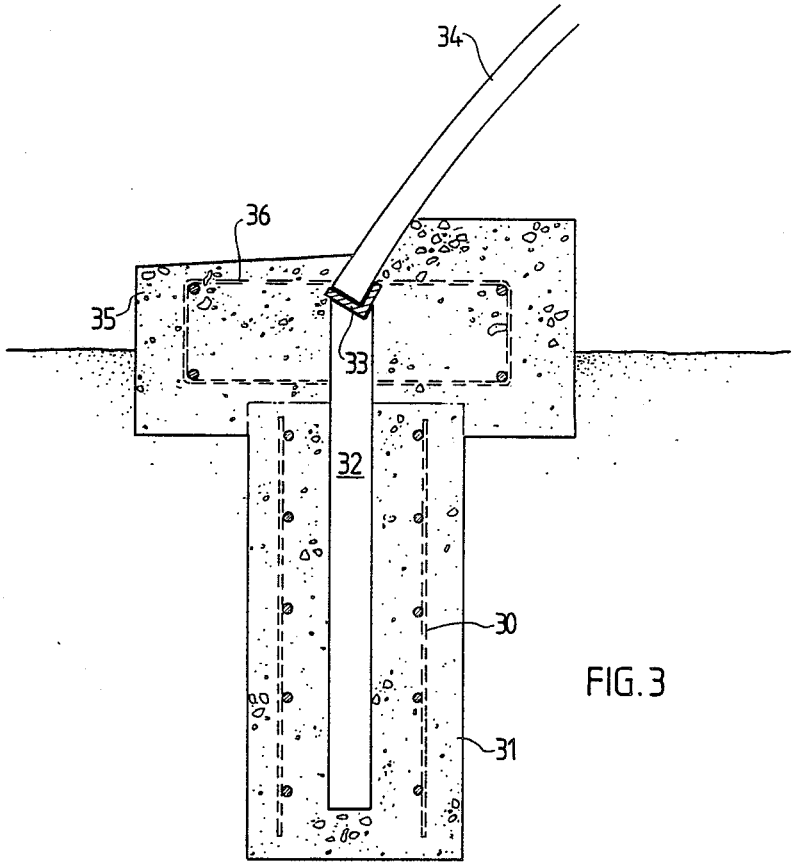
FIG. 3 shows a foundation support structure for a self supporting building.

Using a crane and sling attachment the panel member is then rotated to an upright position and hoisted into position on prepared support foundations shown generally at FIG. 3.

A further panel member comprising five interlocked building panels is then formed in the manner as described above. The further panel member is then hoisted into position adjacent the first panel member with the respective male and female ribs of the panel members overlying each other.

One free end of the further panel member is then aligned with the end of the adjacent free end of the first panel member and the locking tool is clamped over the male and female ribs at the end of the panel members. The locking tool is then tightened to cause the male rib to interlock with the female rib. The locking tool is then drawn over the respective overlying male and female ribs to interlock the panel members over their entire length. Conveniently, a rope is attached to the handle 9 of the locking tool and the rope extends over the erected panel members to a person on the other side of the structure to draw the tool along the joint.

Figure 2:
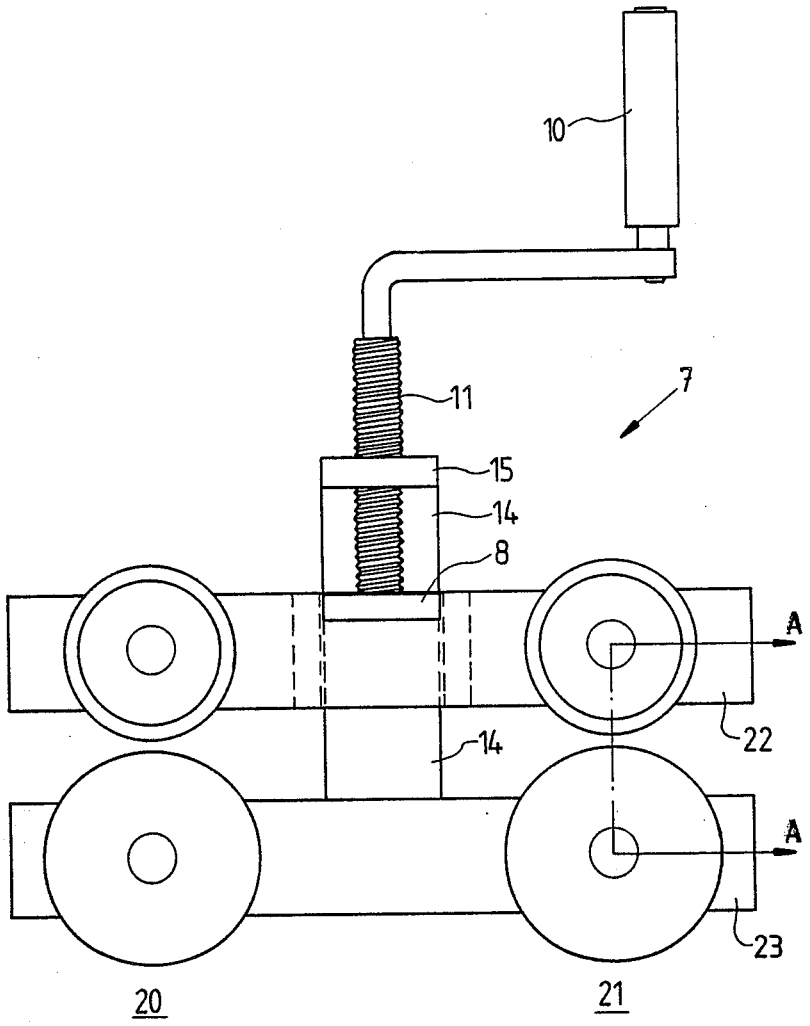
FIG. 2 shows a side elevation of a preferred embodiment of the panel interlocking apparatus according to the invention.
Figure 2A:
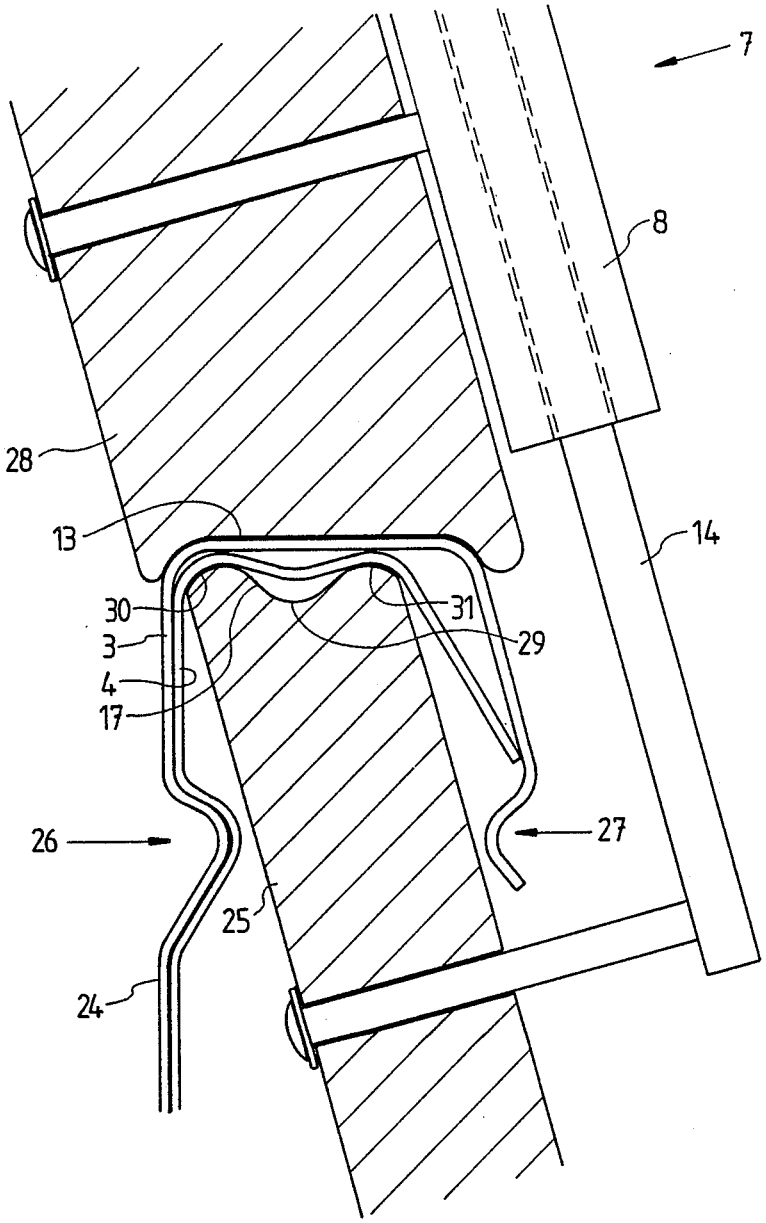
FIG. 2*a* shows a partial cross sectional view to an enlarged scale, taker 9 substantially long line A.

FIG. 2 shows an alternate embodiment of locking tool 7. In this embodiment the slider blocks 12, 16 are replaced by spaced roller assemblies 20, 21 carried on arms 22, 23 mounted on body 8 and bracket 14 respectively. FIG. 2*a* shows an enlarged partial cross section through A—A of the roller assembly of FIG. 2. For the sake of clarity the cross section of a panel joint is also included.

Roller assemblies 20, 21 comprise generally frustoconical members such that locking tool 7 when engaged in the interlocked joint is inclined at an angle relative to side walls 24 of the building panels. This ensures that lower roller 25 does not engage with ribbed projections 26, 27 associated with the panel joint.

Upper roller 28 including a contoured rib engagement surface 13 complementary to the outer exposed surface of female rib 3. Lower roller 25 includes a rib contact surface generally complementary to the exposed surface of male rib 4 but preferably the recessed region 29 between perimetral projections 30, 31 does not contact the corresponding portion of rib 3. In this manner the risk of deforming rib 3 is avoided and at the same time, a reduced contact area is achieved thus reducing frictional resistance during rolling interlocking of the panel joint.

After the required number of panel members has been erected for the building structure, concrete is poured around the support base to firmly anchor the structure to the foundations.

FIG. 3 shows a schematic view of the support foundation for a building constructed in accordance with the invention.

Spaced holes are drilled into the earth around the base perimeter of the proposed structure and these holes are filled with concrete and steel reinforcing members 30 to form piers 31. In addition, steel posts 32 are inserted into the concrete before it sets. Angle iron support channels 33 are welded to the posts 32 to form parallel elongate channels on opposing sides of the proposed arched structure.

Interlocked panel members 34 are erected and supported at their free ends which are welded or bolted to the channels 33 as each successive panel is erected. When all panels are erected and interlocked to form a unitary structure a concrete base 35 reinforced with steel reinforcing members 36 is then formed to lock the structure to the ground.

Figure 4:
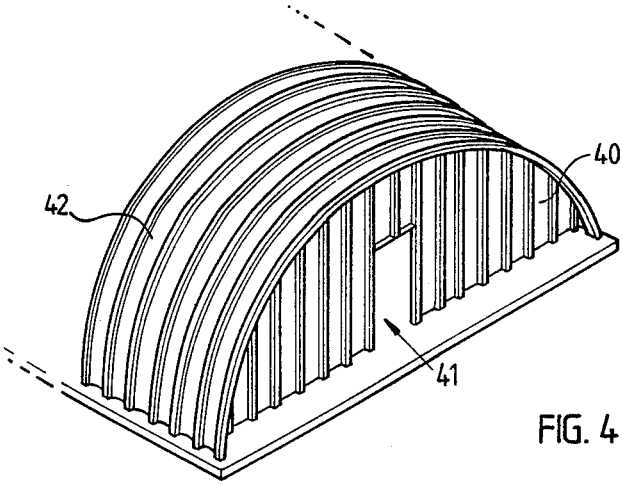
FIG. 4 shows a part view of a completed structure with a planar end wall.

If required, planar end walls may be erected as shown in FIG. 4. These end walls 40 are suitably formed from straight section roll formed channel cutoffs and utilize the same interlocking joint as shown in FIG. 2*a*. The end walls 40 are set in support foundations substantially as shown in FIG. 3 and apertures such as doors 41 or windows may be formed therein. The inner edges of the concrete base 35 form a suitable boxing for an interior concrete floor which may be poured before or after erection of the arched structure 42.

I claim:

1. A method for on-site construction of a self-supporting building utilizing interlocking panel members with each panel member having a male rib and a female rib along respective longitudinal edges thereof, said male rib being engageable within said female rib, for forming a continuous joint comprising the steps of:

(a) erecting a first panel member, (b) positioning a second panel member adjacent to the first panel member with a respective female rib of one of said panel members overlying a respective male rib of the other of said panel members, (c) engaging the female rib with a first contact member being substantially contiguous thereto, (d) simultaneously engaging the male rib with a second contact member, said second contact member defining a recessed surface area and a perimetral projection, said perimetral projection being contiguous to the male rib during engagement for reducing frictional resistance during relative movement therebetween, (e) applying opposed forces to said first and second contact members for urging the male and female ribs into interlocking engagement, and (f) traversing the longitudinal length of the panel members with the engaged first and second contact members to develop a continuous joint between the respective panel members.

2. A method for on-site construction of a self-supporting building utilizing interlocking building panel members with each panel member having a male rib and a female rib along a respective longitudinal side wall thereof, said male rib being engageable within said female rib, for forming a continuous joint comprising the steps of:

(a) erecting a first panel member, (b) positioning a second panel member adjacent to the first panel member with a respective female rib of one of said panel members overlying a respective male rib of the other of said panel members, (c) engaging the female rib with a first contact member being substantially contiguous thereto, (d) simultaneously engaging the male rib with a second contact member, at least one of said contact members having a reduced contact area being non-contiguous with at least one of the ribs for preventing deformation of the rib and for reducing frictional resistance during relative movement therebetween, (e) applying opposed forces to said first and said second contact members for urging the male and the female ribs into interlocking engagement, and (f) traversing the longitudinal length of the panel members with the engaged first and the second contact members to develop a continuous joint between the respective panel members.

3. A method as claimed in claim 2 wherein the second contact member defines a reduced contact area confronting the male rib.

4. A method as claimed in claim 3 wherein the reduced contact area includes a recessed surface region and a perimetral projection being contiguous to said male rib during engagement.

5. A method as claimed in claim 2 wherein at least one of the first contact member and the second contact member is angularly displaced with respect to an axis of the side wall of the panel member to provide clearance for the contact members to traverse the longitudinal length of the panel members.

6. A method as claimed in claim 2 wherein at least one of the contact members is slidably engageable with respect to the ribs.

7. A method as claimed in claim 2 wherein at least one of said contact members is rollably engageable with respect to the ribs.

8. A method as claimed in claim 7 wherein said first panel member is comprised of a plurality of building panel members having interlocked respective adjacent male and female ribs.

9. A method as claimed in claim 2 wherein the second panel member comprises a plurality of building panel members having interlocked respective adjacent male and female ribs.

* * * * *